US008090486B2

(12) United States Patent
Meyer et al.

(10) Patent No.: US 8,090,486 B2
(45) Date of Patent: Jan. 3, 2012

(54) MESSAGE PROTOCOL FOR EFFICIENT TRANSMISSION OF VITAL DIRECTIVES ON A GUIDEWAY

(75) Inventors: Gerhard F. Meyer, Oceanside, NY (US); Richard A. Allshouse, Manassas, VA (US); Robert B. Groves, Jr., Manassas, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 402 days.

(21) Appl. No.: 12/356,425

(22) Filed: Jan. 20, 2009

(65) Prior Publication Data

US 2009/0187295 A1 Jul. 23, 2009

Related U.S. Application Data

(60) Provisional application No. 61/021,847, filed on Jan. 17, 2008.

(51) Int. Cl.
*G05D 1/00* (2006.01)

(52) U.S. Cl. ..... 701/20; 714/49; 714/746; 370/242; 246/1 R

(58) Field of Classification Search ..... 701/29, 701/35, 19, 20, 33, 36; 714/49, 746; 370/242, 370/245; 246/5, 14, 15, 1 R, 187 R, 187 A, 246/187 B See application file for complete search history.

(56) References Cited

U.S. PATENT DOCUMENTS 5,475,818 A * 12/1995 Molyneaux et al. ..... 709/208
5,570,284 A * 10/1996 Roselli et al. ..... 701/2
6,512,968 B1 * 1/2003 de Bellefeuille et al. ..... 701/33

* cited by examiner

*Primary Examiner* — Mark Le
(74) *Attorney, Agent, or Firm* — DeMont & Breyer, LLC

(57) ABSTRACT

A method for delivering and maintaining mandatory directives data from a central office server to an on-board system. Mandatory directives include the enforceable train control data required for a train operating on controlled track. The method enables the on-board system and the central server to exchange data in a vital manner, in part by checking for any inconsistency between i) the on-board system's data as previously transmitted and ii) the required data as represented by both a transmitted set of data identifiers and an associated error correction code.

13 Claims, 4 Drawing Sheets

MESSAGE PROTOCOL FOR EFFICIENT TRANSMISSION OF VITAL DIRECTIVES ON A GUIDEWAY

STATEMENT OF RELATED CASES

This case claims priority of U.S. Provisional Patent Application 61/021,847, which was filed on Jan. 17, 2008 and is incorporated by reference herein.

FIELD OF THE INVENTION

The present invention relates to railway systems in general, and, more particularly, to train control systems.

BACKGROUND OF THE INVENTION

Mandatory directives include the required enforceable "Train Control Data" for a train operating on controlled track. The Train Control Data includes information such as movement authorities, speed restrictions, and the like. This data must be transmitted from the controlling entity to the train both at the trip origin and while the train is en route.

Since this is critical train control data, the exchange of the data must be performed in a "vital" (i.e., safety critical) manner. Failure to deliver vital data can result in unsafe operation of a train. Furthermore, the data on-board must be verified as being current at a frequent rate to avoid operating with stale or missing data.

Transmission of this data occurs over a communications path that typically has a relatively limited bandwidth, yet must accommodate data exchanges between the controlling entity and all operating locomotives and equipped wayside devices. Furthermore, to react quickly to changes in the operating environment, it is important that communications latency is kept as low as possible.

SUMMARY OF THE INVENTION

The prevent invention provides a method for delivering and maintaining mandatory directives data from a central office server to an on-board system in an efficient and vital manner. In the illustrative embodiment, the method is applied to the central server architecture and requires no human intervention (e.g., a user controlling a locomotive by remote control, etc.). The method is implemented in software that is stored in computer-accessible memory and that is suitable for running on a general purpose processor at the central office as well as on-board a train.

The method thereby enables:

- the on-board system and central server to exchange data in a vital manner;
- the on-board system to detect data errors and recognize when a communications outage condition exists;
- the on-board system to react to data errors/outage by entering a restricted mode of operation;
- the data to be resynchronized by the controlling entity to recover from data errors or an outage condition; and
- the on-board system to periodically verify that the data it holds is not compromised and that it is current.

In accordance with the illustrative embodiment, the set of mandatory directives, which represents a significant quantity of data, is sent to the train only once, typically at the trip origin. Rather than re-transmitting the entire command data set at regular intervals for the purpose of updating and verifying the mandatory directives, the present method sends an error detection code, such as cyclical redundancy checks ("CRCs") over data structures, at a fixed interval. In other words, the command data set is not resent. Rather, the current set of data identifiers and the associated error detection code are sent. Sending the error detection code instead of the large data set of mandatory directives requires significantly less bandwidth, while still validating the vitality of the on-board data. Also, since the error detection code comprises a much smaller data set than the entire command data set (i.e., the mandatory directives), a reduction in communications latency is expected as well.

In the illustrative embodiment, the on-board system checks for any inconsistency between its data (as previously transmitted) and the required data, as per the error correction code. If the on-board system detects an inconsistency, it will enter into a restrictive operating mode and report that condition to the controlling entity. Upon receiving such a report, the central server at the controlling entity (e.g., central control center, regional control center, etc.) initiates a synchronization sequence to update any necessary data on the train. Once the train's data is updated, the train is directed to return to a normal operating mode.

The error correction code is sent to the train on a regular basis in a "heartbeat" message that originates from the central server at the controlling entity. Since the heartbeat is sent on a regular basis, the timeliness of the data is ensured.

In addition to verifying the heartbeat data, the on-board system monitors for the absence of the heartbeat itself to detect communications outages. Since messaging is closed-loop, lack of a response by the train to the controlling entities' heartbeat alerts the controlling entity to any communications failure. The central server will time-out any message after a given amount of time (based on message type) and act appropriately. Denial of Service ("DOS") attacks will cause the train to fail safely, since the heartbeat would be lost.

It is notable that the illustrative method ensures the integrity of data over the airways between two vital systems. Each system (i.e., the on-board system and the centralized server) is responsible for maintaining the integrity of data locally. But to the extent that data has been tampered with, the on-board system would detect a mis-compare between that data and the heartbeat error correction code and the system would fail safely.

This method does not address issues such as secrecy and authentication in conjunction with the transmission of the data between the controlling entity and the train. It is to be understood that encryption and authentication techniques can be used in conjunction with the present disclosure to address such issues. Those skilled in the art will know how to apply to implement encryption and authentication to the present method.

A method in accordance with the present invention comprises:

- Receiving, at a train, a heartbeat message at a regular and frequent rate, wherein the heartbeat includes error correction code.
- Comparing on board data with the error correction code.
- Entering a restrictive operating mode if an inconsistency is detected between the on-board data and the error correction code.

DETAILED DESCRIPTION

The following terms are defined for use in this disclosure and the appended claims as follows:

"Vital" means that a function must be done correctly, or the failure to do so must result in a safe state. Vital is synonymous with "safety-critical." A safety-critical system is defined when at least one identified hazard can lead directly to a mishap (accident). Standard 1483 (http://shop.ieee.org/ieeestore/) defines a safety-critical system as one where the correct performance of the system is critical to the safety, and the incorrect performance (or failure to perform the function) may result in an unacceptable hazard. According to most standards, hazards that have risk ratings of "Unacceptable" or "Undesirable" must be mitigated (i.e., reduce the risk, which is generally done by decreasing the frequency of occurrence) through system and equipment design. In order to do this, all of the functions that are necessary to implement the system must be identified. Functions that have to be implemented so that they are both (1) performed and (2) performed correctly are implemented fail-safely and are identified as "vital" functions. The fail-safely implementation means that all credible failures that could occur are examined and the occurrence of any one of them (or combination of failures in the event that the first failure is not self-evident) maintains the system in a safe state. That can be done either by forcing the system to a stop (or other safe state such as a less-permissive signal) or by transferring control to a secondary system, such as a redundant computer.

Figure 1:
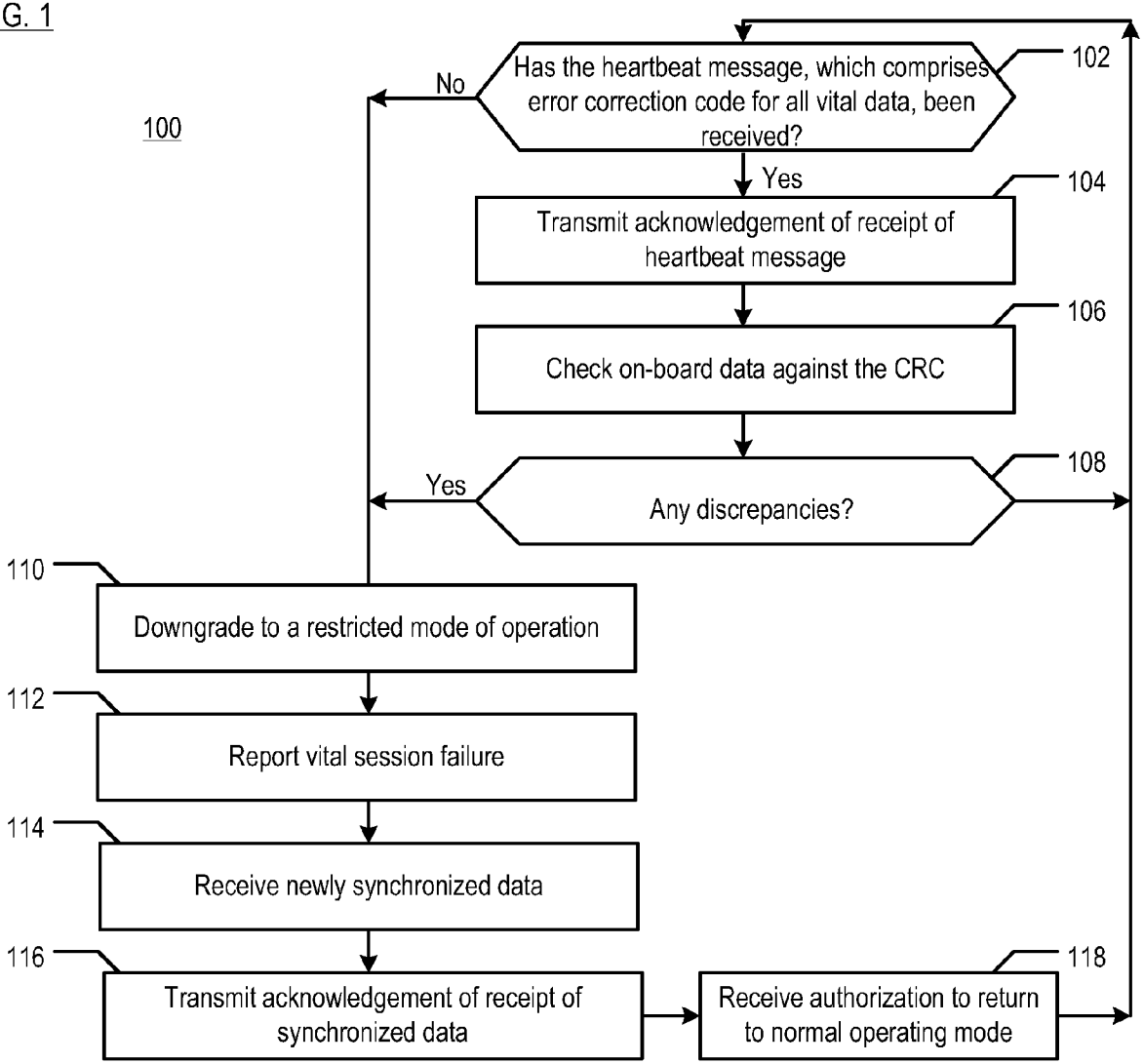
FIG. 1 depicts a flow diagram of a method in accordance with the illustrative embodiment of the present invention.

FIG. 1 depicts a flow diagram of method 100 in accordance with the illustrative embodiment of the present invention. The operations recited in method 100 are from the "perspective" of the train. In the embodiment of the method that is depicted in FIG. 1, the full set of mandatory directives has already been transmitted to a train from a central server of a controlling entity. Throughout this specification, the terms "central server" and "controlling entity" are occasionally used interchangeably, since the distinction is generally not significant in the context of the invention and will be understood by those skilled in the art. It is understood that the central server is actually a processor that is operating under the auspices of the controlling entity.

In operation 102 of method 100, the train monitors for a heartbeat message, which is transmitted over a wireless communications channel by the controlling entity. The heartbeat is transmitted at some frequent interval based on the allowed window of jeopardy for safety hazards and communications channel latency. The heartbeat includes error correction code for all vital data.

A variety of error correction codes are available for use in conjunction with the illustrative embodiment. One such code is a "cyclical redundancy check" or "CRC." A CRC is a type of function that takes as input a data stream of any length, and produces as output a value of a certain space, commonly a 32-bit integer. The term "CRC" denotes either the function or the function's output. A CRC can be used as a checksum to detect accidental alteration of data during transmission or storage. CRCs are particularly good at detecting common errors caused by noise in transmission channels. CRCs are not standardized, although the CRC-32 polynomial, recommended by the IEEE and used by V.42, Ethernet, FDDI and ZIP and PNG files among others, is the generating polynomial of a Hamming code and is used for its error detection performance on communication channels.

If the heartbeat message is received, the on-board system transmits an acknowledgement of receipt to central server, as per operation 104. The on-board system then checks, in accordance with operation 106, the version of the mandatory directives that are stored on-board the train against the error correction code received in the heartbeat message. A discrepancy would indicate that there has been some data corruption and/or that the data is stale, due to transmission failures or communications outages.

Method 100 queries, at operation 108, whether there are any discrepancies. If there are no discrepancies, processing returns to operation 102 wherein the train waits to receive the next heartbeat message.

If the train does not receive the heartbeat message (operation 102) or discovers a discrepancy between the on-board version of the mandatory directives and the error correction code, the onboard system downgrades the train's operational status to a restricted mode (e.g., speed restrictions, altered permissions, etc.), as per operation 110.

The train transmits a message to the central server/controlling authority reporting the session failure, in accordance with operation 112. Assuming that there is a data discrepancy, the central server determines which data is responsible for the discrepancy and transmits this vital train control data to the on-board system. This transmission is not part of a heartbeat message. Thus, at operation 114, the train receives (re)synchronized data. Acknowledgement of receipt of the synchronized data is transmitted to the central server, as per operation 116.

Upon receiving confirmation from the train that the vital train control data has been synchronized, the central server will issue an authorization to resume normal operation. This may be transmitted with the heartbeat message. Thus, at operation 118, the train receives authorization to return to normal operating mode. The method then loops back to operation 102 wherein the train waits to receive the next heartbeat message.

Figure 2:
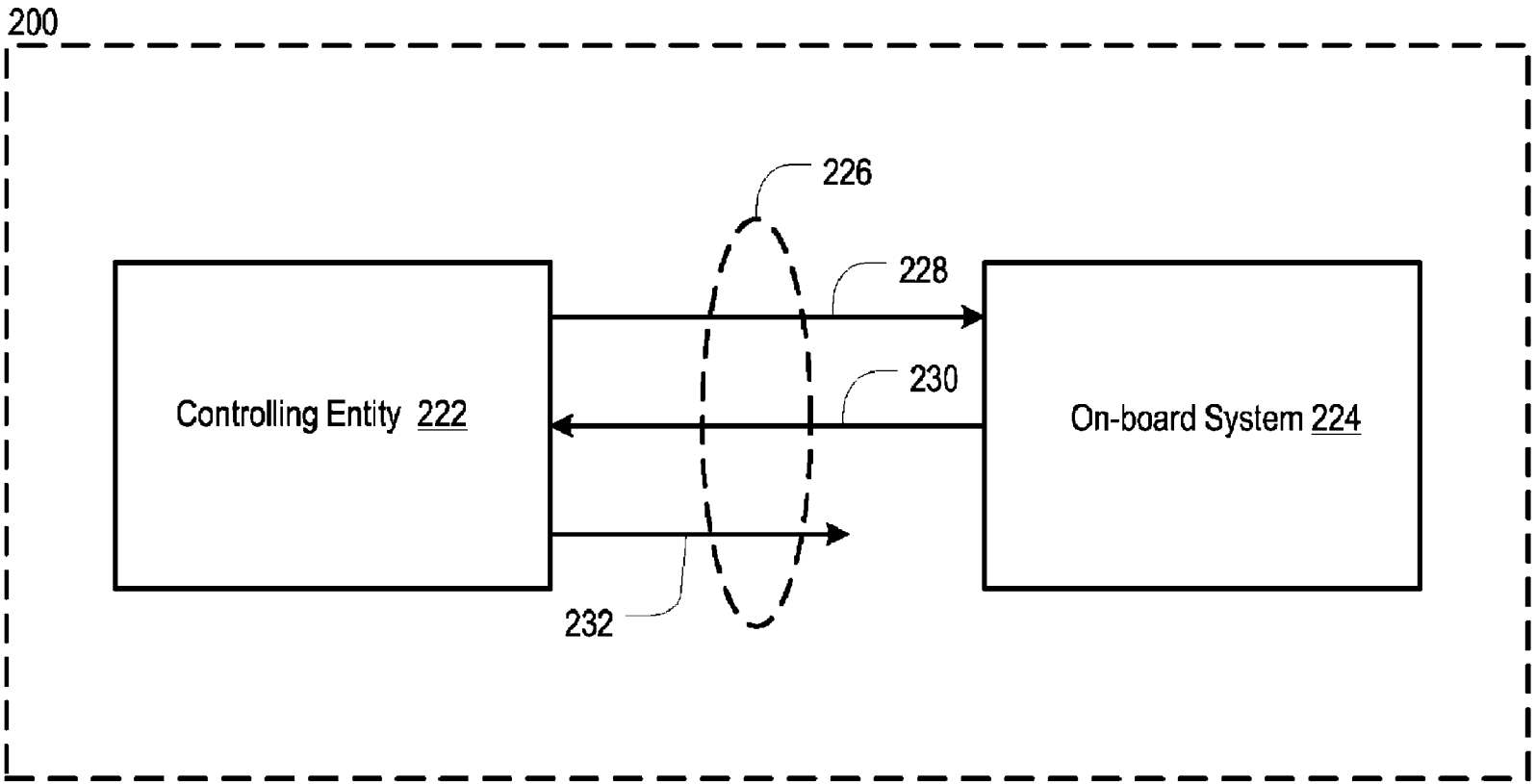
FIG. 2 depicts closed-loop messaging for vital train control in accordance with the illustrative embodiment of the present invention.
Figure 3:
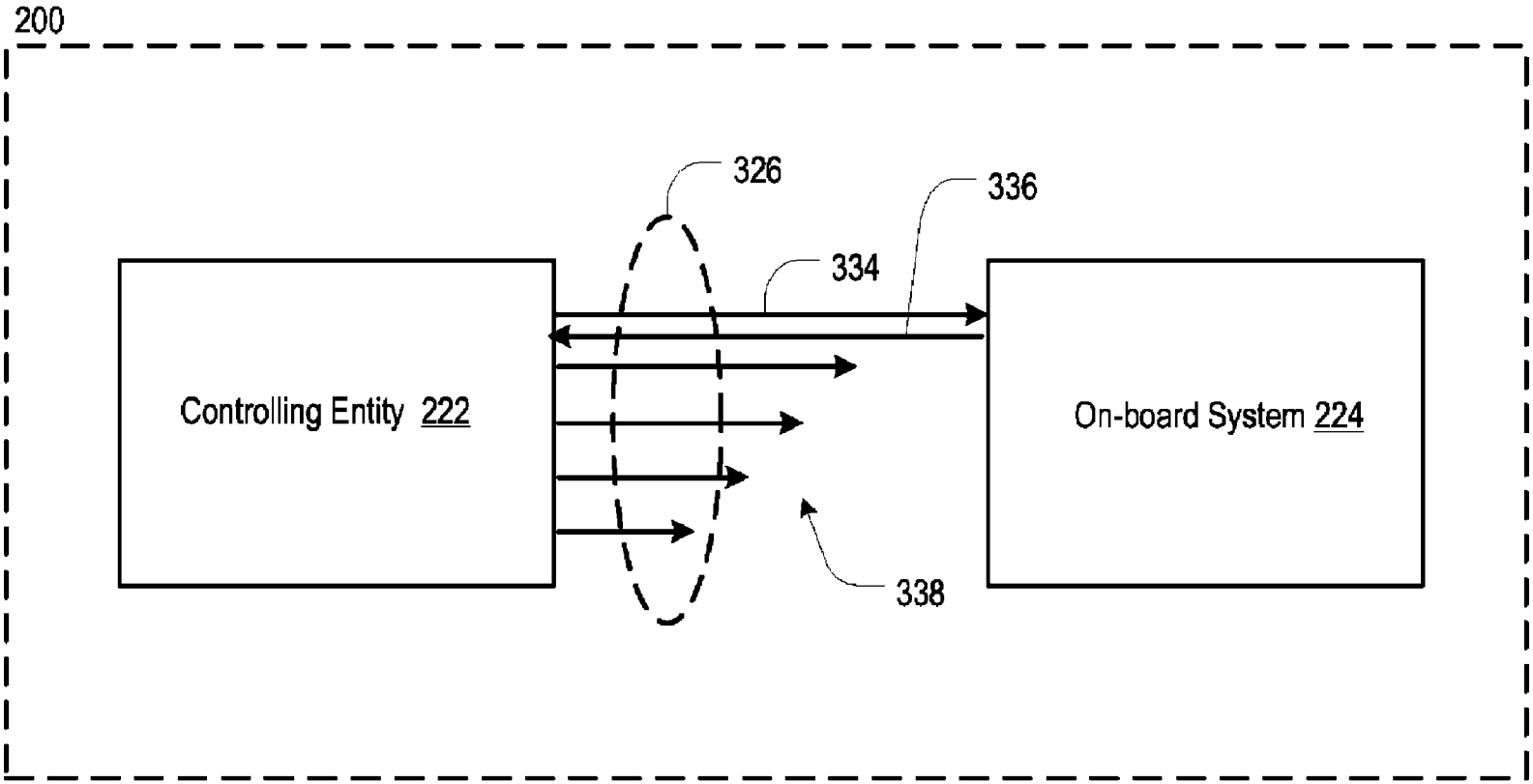
FIG. 3 depicts the use of periodic heartbeats to confirm that the vital train control data is current in accordance with the illustrative embodiment of the present invention.

FIG. 2 depicts the application of closed-loop messaging to system 200 in accordance with the illustrative embodiment. As depicted in FIG. 3, controlling entity 222 transmits message 228 containing vital train control data (e.g., authorities, bulletins, wayside status, etc.) over communications channel 226 to on-board system 224. This occurs once, typically at the trip origin. When message 228 is received, on-board system 224 sends acknowledgement message 230 over communications channel 226 to controlling entity 222. If the controlling entity does not receive a response or a non-acknowledgement, it re-sends the train control data, as indicated at 232.

FIG. 3 depicts the concept of the heartbeat message being sent from controlling entity 222 to on-board system 224. As per FIG. 3, the controlling entity transmits heartbeat message 334 over limited-bandwidth communications channel 326. The on-board system confirms receipt of heartbeat message 334 via message 336. Using the error correction code of all vital train control data, on-board system 224 tests for missing or erroneous data. The controlling entity sends the heartbeat message on a continuing basis, as indicated by messages 338. This regular frequency of transmissions, and the checks being performed by on-board system 224, guarantees that the train is operating with proper data with a minimal window of jeopardy.

Figure 4:
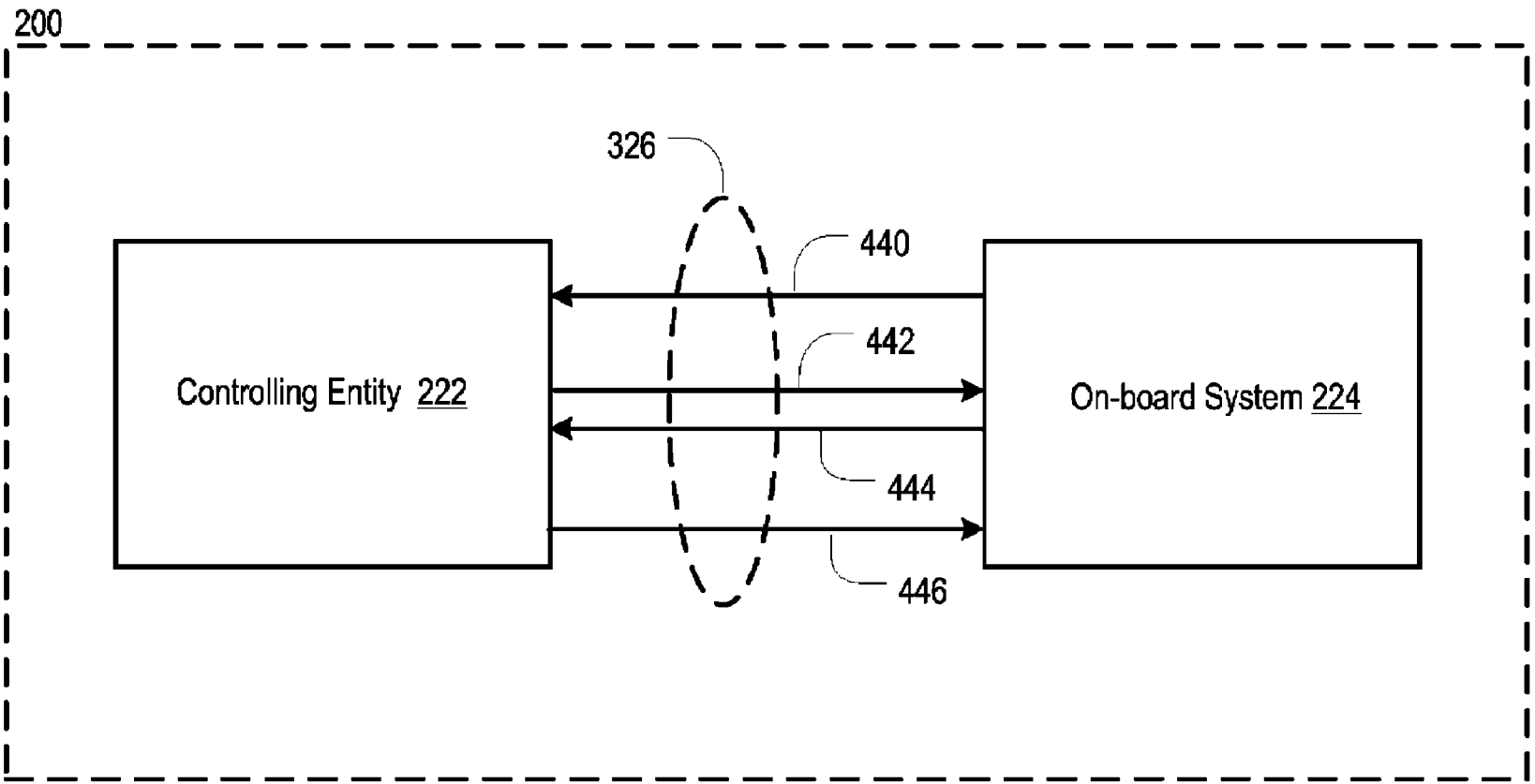
FIG. 4 depicts a resynchronization sequence that is used to restore the control system to normal operation in accordance with the illustrative embodiment of the present invention.

FIG. 4 depicts the re-synchronization sequence that occurs when a discrepancy or communications failure is reported. As depicted in FIG. 4, on-board system 224 transmits message 440 over communications channel 336 reporting a vital session failure. Controlling authority 222 determines which data is responsible for the discrepancy and transmits message 442 containing this vital train control data to on-board system 224. The on-board system sends message 444 acknowledging receipt of the (re)synchronized data. When the controlling authority receives message 444, it transmits message 446 to the on-board system authorizing a resumption of normal train control operation. In some embodiments, message 446 is a heartbeat message. In other words, the authorization is sent with the error correction code, etc., in the heartbeat message.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A method comprising:

receiving, by an on-board system situated on a train, a first message containing a set of mandatory train directives that comprise train control data for the train;

subsequent to receiving the set of mandatory train directives, receiving a plurality of regularly-transmitted heartbeat messages at a train; wherein a heartbeat message from the plurality includes i) a current set of data identifiers and ii) error detection code associated with the current set of data identifiers; wherein the heartbeat message from the plurality does not include the train control data; and wherein the error detection code comprises a smaller data set than the set of mandatory train directives;

comparing, for a discrepancy, the error detection code in each heartbeat message, when received, against a copy of the mandatory train directives that is stored in the onboard system; and altering a normal operating mode of the train to a relatively more restrictive operating mode when a discrepancy is identified.

2. The method of claim 1 wherein the set of mandatory train directives is received once during a trip of the train.

3. The method of claim 2, wherein the set of mandatory train directives is received at the origin of the trip.

4. The method of claim 1 further comprising transmitting a message comprising a report of a session failure when one of the heartbeat messages is not received when expected per a transmission schedule.

5. The method of claim 4 further comprising altering the normal operating mode of the train when one of the heartbeat messages is not received.

6. The method of claim 1 further comprising transmitting a message comprising a report of a discrepancy when such discrepancy is identified.

7. The method of claim 6 further comprising receiving, after transmitting the report of the discrepancy, updated data pertaining to the discrepancy in the copy of the mandatory train directives.

8. The method of claim 1 further comprising receiving a directive to return to the normal operating mode after the discrepancy is corrected.

9. The method of claim 1 wherein the train control data comprises wayside status.

10. The method of claim 1 wherein the error detection code comprises a cyclical redundancy check.

11. A method comprising:

transmitting, by a server that is separate from a train, a first message containing a set of mandatory train directives that comprise train control data for the train, to an onboard system situated on the train; and transmitting, on a periodic basis and subsequent to the first message, a heartbeat message to the train, wherein the heartbeat message contains error detection code associated with the vital train control data, wherein the error detection code comprises a smaller data set than the set of mandatory train directives, and wherein the heartbeat message does not include the train control data.

12. The method of claim 11 further comprising receiving a message pertaining to a session failure when:

(a) there is a discrepancy between the error detection code received by the on-board system and a copy of the mandatory train directives that is stored in the on-board system; or (b) the train does not receive the heartbeat message.

13. The method of claim 12 further comprising initiating a synchronization sequence upon receipt of the message pertaining to session failure, wherein the synchronization sequence updates the copy of the mandatory train directives.

* * * * *